United States Patent [19]

Bader

[11] Patent Number: 4,598,668

[45] Date of Patent: Jul. 8, 1986

[54] APPARATUS FOR EFFICIENTLY CONTROLLING THE OPERATION OF PARALLEL BOILER UNITS

[75] Inventor: Lawrence M. Bader, Peekskill, N.Y.

[73] Assignee: Energy Systems and Service Corp., Peekskill, N.Y.

[21] Appl. No.: 690,112

[22] Filed: Jan. 9, 1985

[51] Int. Cl.[4] ..... F22B 37/42; F22D 5/36

[52] U.S. Cl. ..... 122/448 B; 122/447; 122/504; 122/504.2; 236/21 R; 236/46 R

[58] Field of Search ..... 122/1 R, 446, 447, 448 R, 122/448 A, 448 B, 448 S, 452, 504; 236/21 R, 21 B, 26 R, 26 A, 26 E, 46 R

[56] References Cited

U.S. PATENT DOCUMENTS

| | | | |
|---|---|---|---|
| 2,416,781 | 3/1947 | Thomson | 122/504 |
| 3,387,589 | 6/1968 | Chan et al. | 122/1 R |
| 3,572,587 | 3/1971 | Oldenburg | 236/26 R |
| 4,007,713 | 2/1977 | DeLeonardis et al. | 122/504 |
| 4,421,068 | 12/1983 | Aral | 122/448 B |
| 4,498,428 | 2/1985 | LeSpisa et al. | 122/448 R |

*Primary Examiner*—Albert J. Makay
*Assistant Examiner*—Steven E. Warner
*Attorney, Agent, or Firm*—Arthur L. Plevy

[57] ABSTRACT

There is disclosed a control apparatus for operating any one of a plurality of parallel connected boilers as a lead boiler, with the others operating as lag boilers. The control apparatus enables a lag boiler to assist the lead boiler during a prolonged operating period to share the burden and the therefore prolong equipment life and increase system efficiency. The control apparatus enables each boiler to serve as the lead boiler while employing full modulation, other boilers such as the lag boiler also employ full modulation. The control apparatus also causes an automatic switch over between boilers after a malfunction of one of the boilers in a rapid time.

10 Claims, 3 Drawing Figures

APPARATUS FOR EFFICIENTLY CONTROLLING THE OPERATION OF PARALLEL BOILER UNITS

THE BACKGROUND OF THE INVENTION

This invention relates to boiler systems in general and more particularly to a control system for controlling the operation of a series of boilers to achieve maximum efficiency of operation.

Modern day boilers are designed for efficient operation and as such include modulation apparatus. Essentially, the term modulation means to adjust by increments and decrements or to modify by varying a second condition the firing rate position of a boiler. In this manner, the firing rate of the boiler is under the control of an external control panel or control apparatus. In order to provide modulation, boilers employ a flame safeguard control that provides an infinite number of firing rate positions to allow the boiler to fire in response to demand. The modulating controller is a device which automatically positions the firing rate of the boiler between its extreme positions in response to system demands. Thus many manufacturers supply boilers which incorporate modulation controllers as described. See for example a brochure entitled M-SERIES GAS AND OIL BURNERS by IC, Industrial Combustion of Milwaukee, Wis. This brochure describes a full modulating burner for a boiler as well as high-low modulating burners.

These boilers in automatic operation employ a sequential operating cycle which operates the burner and the boiler through pre-purge, pilot ignition, main flame ignition, run and post purge. The length of purge and ignition trial vary according to the type of programmer controller employed. During the run cycle, burner output is regulated to the load demand by the modulating pressure or temperature control on the boiler. The burner will continue to modulate until the operating pressure or temperature is reached.

Thus many manufacturers supply programming controls to allow modulating operation of boilers. See for example a brochure entitled FLAME SAFEGUARD PROGRAMMING CONTROLS (R4140L) by Honeywell of Minneapolis, Minn. (1979). This describes programmers or controllers which provide flameout protection plus automatic sequencing of the burner motor (blower), firing rate motor, ignition, pilot value and main fuel valves for commercial and industrial burners on boiler using coal, gas, oil or a combination of fuels.

In many modern facilities, boilers are used in parallel. A modern building or plant may use at least two or more boilers which are arranged in parallel and are operated to supply the peak and normal demands of a facility. As such there is a lead boiler and at least one lag boiler in such systems. The lead boiler is used as the main system boiler with the lag boiler employed as a back-up device when the lead boiler fails. This type of operation as will be explained is very inefficient and results in many problems in that the full modulating capabilities of the boilers are not employed and thus results in shortened boiler life due to the extended use of the lead boiler as controlled by certain prior art systems techniques.

Cognizant of such problems, certain manufacturers attempted to solve these problems by providing Lead-Lag programming controllers. See a brochure entitled CHIEF DISPATCHER by Preferred Instruments of Danbury, Conn. (1972) BULLETIN SDI-JD-DCBF(A). This describes a lead-lag programming control to integrate the multiple boiler installation into a coordinated system. Thus the controller automatically sequences the firing of several boilers in balance with changing load conditions. The unit programs the individual boilers in or out of operation in response to predetermined pressure or temperature variations. This is done to equalize equipment usage rate. Hence the user can select any boiler as the lead boiler by rotating an external sequence selector switch and lead boiler can be changed as often as desired. However, this has to be done manually and this operation is often neglected. Thus the same company provides an alternative model. See BULLETIN SDI-JC-CDDF(A) (March, 1972) where the system described automatically alternates the lead boiler with each call for operation. For example, on the first call the No. 1 boiler will fire as the lead boiler. On the next call the No. 2 boiler will fire as the lead boiler and so on. If a lead boiler fails, another boiler will take its place.

However, this prior art approach is attendant with many problems due to the fact that if there is a failure of the lead boiler, the next lag boiler, which is the next boiler in line, will come on only after the pressure has dropped to the lag boiler setting. By this time, the system has lost pressure and energy and the lag boiler due to system operation will not meet the lead boiler's load. This is because the operating and modulation controls of each boiler does not change when a new lead boiler is selected. Hence a former lag boiler when selected as the lead boiler still has the lag boilers modulation and operating control rate and therefore the lag boiler selected cannot operate to meet the lead boiler's load requirements.

It is, thereofore, an object of the present invention to provide an improved boiler control apparatus whereby the operating control and modulation of a boiler is changed when that boiler is selected as a lead boiler to thereby achieve increased efficiency and prolong boiler life.

BRIEF DESCRIPTION OF THE PREFERRED EMBODIMENT

Control apparatus for selecting any one of a plurality of parallel boiler units to serve as a lead boiler, with the others in said plurality operating as lag boilers, with each of said boilers capable of providing outputs indicative of a failure mode, and with each of said boilers capable of providing a modulation of operation between a lead pressure value and a lag pressure value, based on an internal program for individual control of each boiler, comprising first selection means for selecting any one of said plurality of boilers to operate as said lead boiler, load pressure means responsive to said selected boiler for monitoring the lead pressure output of said selected boiler to determine operation in an acceptable range, selectively operated means responsive to said first selection means to enable at least one other boiler in said plurality to operate as a lag boiler when selected, timing means responsive to said monitored lead pressure coupled to said selectively operated means to cause said means to operate after a given period of operation of said lead boiler at said lead pressure, whereby said lag boiler is selected to aid said lead boiler in operation even though said monitored pressure is within said acceptable range.

DETAILED DESCRIPTION OF THE FIGURES

Before proceeding after a detailed description of the Figures, it is explained that the operation of the controller of this invention is made with regard to the control of two boilers where any one of the two can be selected as the lead boiler with the other selected as the lag boiler.

For purposes of explanation, there is described a two boiler operation for steam boilers which steam boilers are well known in the field.

Figure 1:
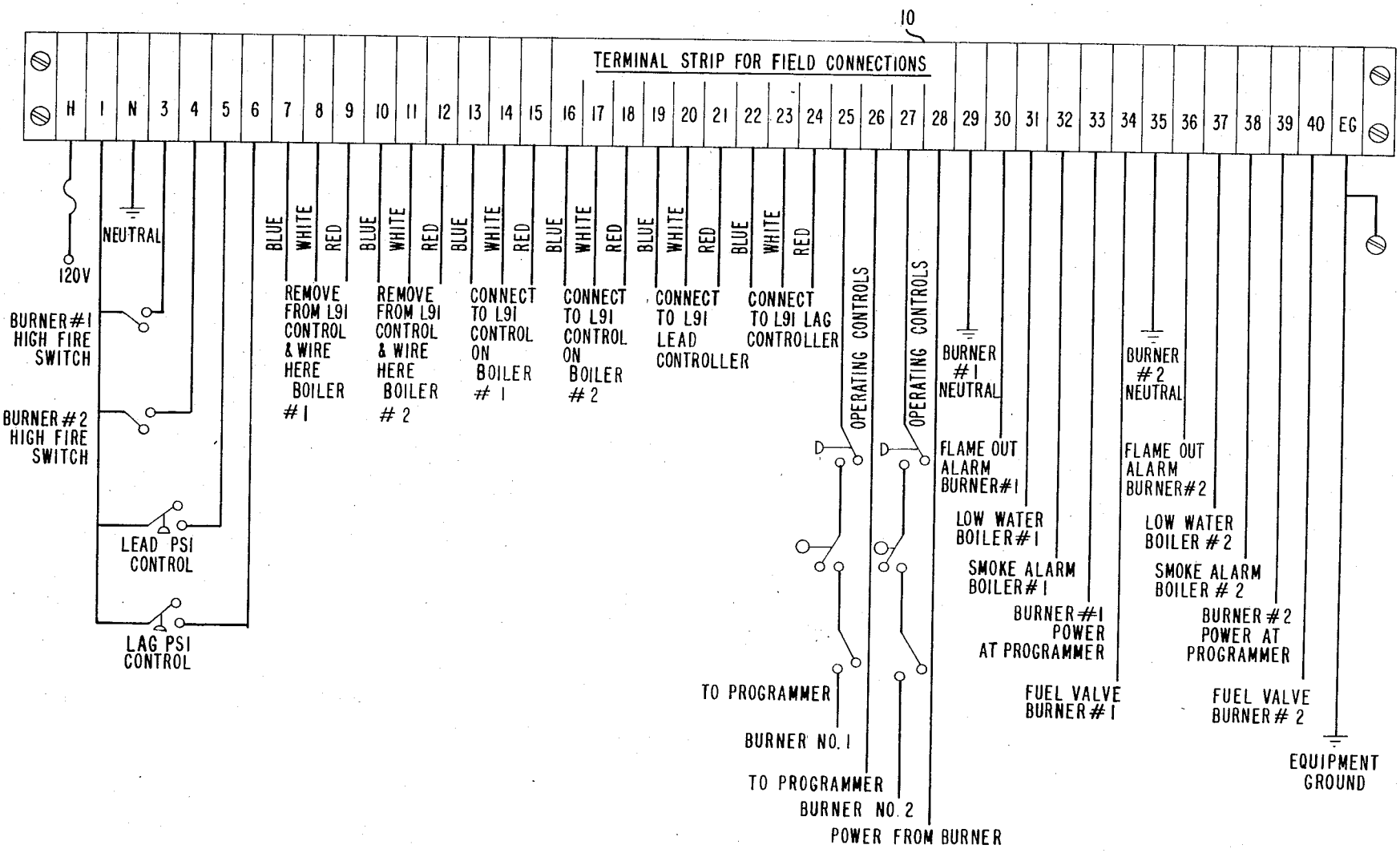
FIG. 1 is a schematic diagram depicting a terminal board layout for connecting the control apparatus of this invention to lead and lag boilers.

FIG. 1 depicts a terminal strip consisting of terminals designated as 1–40, with terminals H, N and EG. The Figure depicts the typical field connections available from such boilers as presently available. The boilers as indicated are steam boilers and essentially include four malfunction terminals as flame failure, power failure, low water and smoking. All connections from the terminal configuration of FIG. 1 are directed to the controller circuit shown in FIGS. 2A and 2B as will be explained. All connections are in series with the burner operating control circuit.

As seen in FIG. 1, the appropriate leads from boilers 1 and 2 are wired to the terminal strip 10 according to the following chart. The term L91 refers to the boiler modulation controller which controller is well known in the field and controls the modulation of each boiler unit. Thus one wires each boiler in a two boiler system to the terminal strip 10, according to that shown in FIG. 1 and based on the following table:

EXTERNAL ON THE JOB CONNECTIONS

TERMINAL

H. Hot 120 Volts a/c.

N. Common neutral.

3.-1. Burner 1 high fire switch.

4.-1. Burner 2 high fire switch.

5.-6. Lead pressure control on a common header.

6.-1. Lag pressure control on a common header.

7-8-9-. Are for modulation, remove existing wire from series 90 controller (L91) on the boiler and wire to these terminals by color 7-blue 8-white 9-red from boiler 1.

10-11-12. Same as above for boiler 2.

13-14-15. Connect to series 90 controller (l91) on the #1 boiler by color 13-blue 14-white 15-red.

16-17-18. Same as above for #2 boiler.

19-20-21. Connect to series 90 controller (L91) on Lead L91 on the common header. 19-blue 20-white 21-red.

22-23-24. Same as the above for lag L91.

25-26. The control circuit of FIG. 2 is to be wired in the operating circuit before the operating boiler controls—IN SERIES ONLY #1 BOILER.

27-28. Same as above for #2.

29. Burner 1 control neutral.

30. Burner 1 flame failure circuit on programmer.

31. Low water circuit on #1 boiler. Manual reset. . .

32. Smoke alarm circuit #1 boiler.

33. Burner power from programmer. #1 boiler.

34. To main fuel valve 7 on programmer #1 boiler.

35. Burner #2 control neutral.

36. Burner #2 flame failure circuit to programmer.

37. burner power from programer. #2 boiler.

38. Smoke alarm circuit, #2 boiler.

39. Burner power from programmer. #2 boiler.

40. To main fuel valve 7 on programmer #2 boiler.

EG. EQUIPMENT GROUND . . .

Figure 2A:
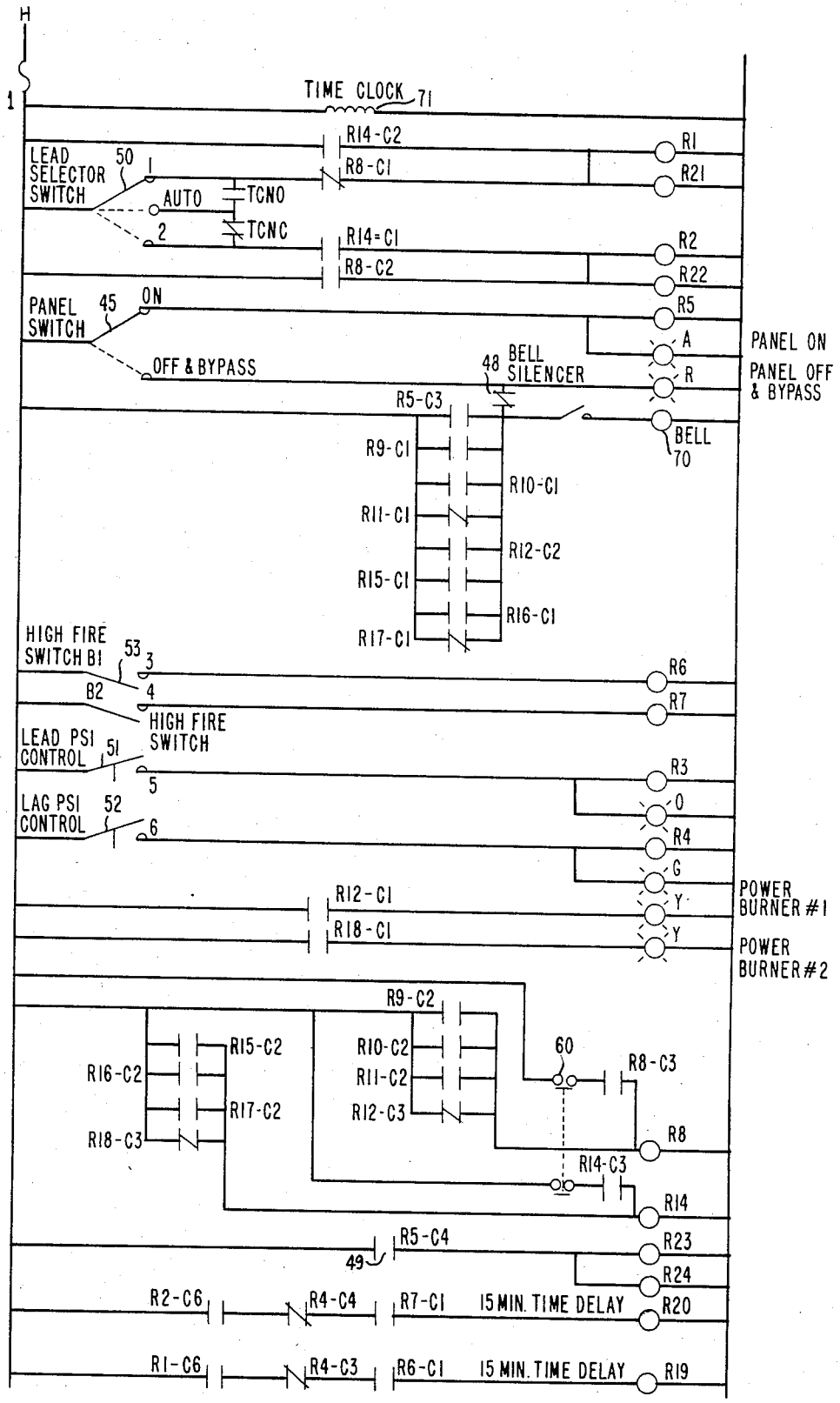
FIGS. 2A and 2B are a detailed schematic diagram of a control apparatus according to this invention.

Referring to FIGS. 2A and B, there are shown a schematic of the control circuit for the two boiler system. The reference numbers next to the appropriate leads refer to those numerals at the terminal strip 10 of FIG. 1.

Operation is as follows. To start one control operation, the controller of FIG. 2A is turned on. This is done by moving the ON-OFF panel switch 45 to the ON position. The relay coil R5 (shown in a circle) is energized, with lamp A also energized indicating that the control panel and therefore the controller is activated.

Figure 2B:
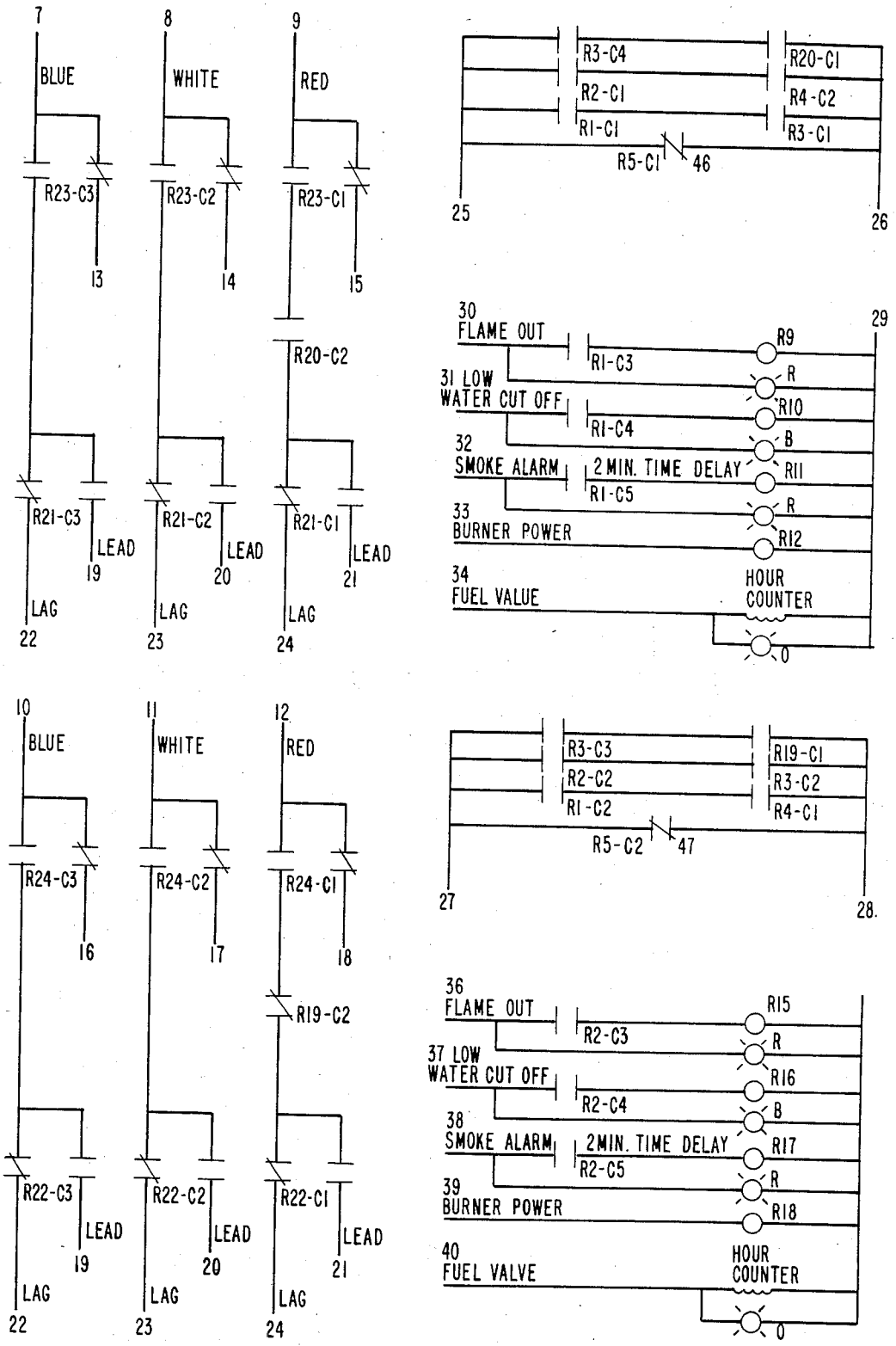

As can be seen from FIG. 2B, the contacts associated with coil R5 are designated as R5C1, R5C2, R5C3, R5C4. These contacts are also designated by numerals 46, 47, 48, 49 for clarity. In conventional form a normally closed contact is represented by two vertical lines with a cross line as R5-C1, while a normally opened contact is represented by two vertical lines as R5-C4.

As one can see from FIG. 2B, R5-C1 normally shorts terminal 25 to 26 of FIG. 1 and R5-C2 shorts terminal 27 to 28 of FIG. 1. By operating R5, one placed the control circuits of boilers 1 and 2 in series with the control circuit of FIG. 2A. R5-C3 de-energizes the power going to the alarm for by-pass operation while R5-C4 operates relay coils R23 and R24. These relays are associated with contracts R23C1, C2 and C3 and R24C1, C2, C3. As can be seen from FIG. 1, the R23 contacts are in series with terminals 7, 8 and 9 which is the modulation control for boiler 1, while the R24 contacts are in series with terminals 10, 11, and 12 of FIG. 1 which are the modulation control terminals for boiler 2. As will be explained, modulation control is now under control of the control circuit of FIGS. 2A and 2B.

A second switch 50 is shown in FIG. 2A, this allows one to select either boiler 1 or 2 as the lead boiler. If switch 50 is placed in the position shown, boiler 1 is selected, in the lower position (dashed line) boiler 2 is selected and in the center position automatic operation is provided. When boiler 1 is selected as the lead boiler relay coils R1 and R21 are energized.

Thus for energizing R1, contacts R1-C1 C2, C3, C4, C5 close. For energizing R21, contacts R21, C1, C2, C3 close. The closing of the contacts R21, C1, C2, C3 now connects terminals 7, 8, and 9 of boiler 1 to terminals 19, 20 and 21 to allow boiler 1 to become the lead boiler. The closing of these contacts put boiler #1 modulation as lead modulation. For example, the lead pressure is set at 10 psi with the lag pressure set at 8 psi. Thus in each boiler programmer (L91) the lead pressure is set at 10 psi and the lag pressure is set at 8 psi or some other convenient values for lead and lag pressure.

The lead pressure control is R3 and the lag pressure control is R4. As one can see from FIG. 2A, R3 is a relay coil connected to terminal 5 which is connected to the lead control switch 51 of boiler 1. The lag control switch 52 is connected to terminal 6 and is associated with coil R4.

Now both boilers are turned on and they are running. Assume the pressure is 7 psi. The lag boiler which is #2 starts modulating down to low fire and the pressure goes up to 8 psi, the lag boiler shuts off on low fire. When this occurs, coil R4 is de-energized by opening of the lag control switch 52.

Since boiler 1 is in a high fire mode, relay R6 (connected to terminal 3) will close after a suitable time interval due to the closing of the high fire switch 53 of boiler 1. Relay coil R6 is a time delay relay. When R6 activates, R19 is activated due to its coil in series with contacts R1-C6, (closed due to R1 operation) R4-C3 (closed because of deactivation of R4) and R6-C1 closed because of high fire operation of boiler 1. When R19 energizes after the delay and hence contact R19-C1 closes. This contact is in series with R3-C3 across terminals 27 and 28 of FIG. 1 which are the control terminals for boiler 2. Relay coil R3 is operated because the lead pressure control switch 51 is still on.

Now boiler #2 will come on and stay in the low fire mode if R19-C1 is closed. When the lag boiler comes on, this helps the lead boiler maintain the load. If the lead boiler stays in the high fire mode too long after the lag boiler shuts off, the lag boiler comes on to help the lead boiler. For example, after the lag boiler has gone off on pressure, the lead boiler can only maintain that pressure load and if the load demands stay the same, the lead boiler is overworked. Now the second boiler will shut off after either the lead boiler has gone on low fire or has shut off on lead pressure.

Assume now that the lead boiler is holding the load pressure and stops in low fire after the lag boiler has shut down. Assume that the lead boiler has gone into flame failure. This causes relay R9 to operate as connected to terminal 30 of FIG. 1. When R9 operates, contact R9-C2 operates relay coil R8, this coil latches via its own contact R8-C3 and via closed switch 60. Operation of relay coil R8 opens relays R1 and R22 via switch 50. Contact R8-C2 energizes coils R2-R22 associated with boiler 2. Contact R9-C1 also operates due to flame out of boiler and this sounds an alarm via the bell alarm 70. Relay coil R8 does not release until switch 60 is operated when the malfunction is corrected. As one can see, if the lead boiler experiences a low water cutoff R10 operates which sounds the bell via contact R10-C1 and which operates relay coil R8. If there is a smoke alarm then coil R11 operates to sound the alarm via R11-C1 and to operate R8 as above. The same occurs for the smoke alarm by operating R11, for burner power by operating R12 and so on.

The same exact sequence occurs if one selects boiler 2 as the lead boiler via placing switch 50 in the lower position. As can be seen from FIG. 2A, boiler 2 has exact components which allow it to act as a lead boiler for the setting of switch 50 in the lower position. Hence R2 and R22 are analogous to R1 and R21. R7 is analogous to R6. R19 is analogous to R20. R14 is analogous to R8 and so on. Each boiler has the following same failure modes. As flame out R9, R15, low water cutoff R10, R16, smoke alarm R11, R17, burner power R12, R18 and fuel value (HOUR-COUNTER). The HOUR-COUNTER is included to monitor fuel value operation in a known manner. From FIG. 2A it is seen that certain coils are paralleled with a lamp indicator or a pilot light, shown as a circle with four lines directed therefrom. These are panel lights to allow a user to view the monitored conditions as each burner failure mode as above described, lead and lag control, panel on, panel off and hour counter status.

For automatic operation when the switch is placed in the center position contacts TCNO and TCNC are controlled by the timer winding 71. Hence these contacts are controlled to sequence in time the selection of boiler 1 or 2 as the lead and lag boilers by adjusting the clock.

Thus the controller described above is a sophisticated lead lag boiler control system. The switch 45 if operated in the by pass position completely disables the controller and allows each boiler to operate based on its local programmer (L91).

There is an automatic switch over of boilers during a failure mode. The system prevents the overload of one boiler or the lead boiler when the lag boiler is in the OFF cycle and the load stays the same. There is always full and complete modulation. The time clock 71 allows automatic operation to allow automatic boiler change from lead to lag as desired.

The central system saves energy, boiler life, burner short cycling and provides a smooth operation than prior art devices.

Thus during abnormal loads, when the lead boiler is operating for a prolonged period, without a load change, the controller will cause the lag boiler to operate after a 15 minute delay for the ON cycle for the lead load operation and maintains a low backup firing rate at this position. This prolongs the life of the equipment. Upon power failure of the controller the system returns to individual boiler controls. The clock allows automatic operation and boiler selection from hourly to weekly stages.

Hence the lead boiler is controlled to operate to control the peak range with the lag boiler controlling the backup range. The modulation completely recycles with the lead lag programming. With full modulation, the system prolongs the life of the boilers and provides a more stable feed water supply, reduced electrical power surges and reduced heat loss. If a lead boiler fails, the next boiler in line assumes full lead position automatically only losing seconds of cycle operation necessary for the burner programmer to recycle itself. The following parts lists was employed in conjunction with the circuitry of FIGS. 2A and 2B:

| MANUFACTURER | DESCRIPTION | MODEL | VOLTS & AMPS |
|---|---|---|---|
| Dayton Controls | Delay Relay R6, R7 | 6X601 | 120 vac-10 A |
| Dayton Controls | Relay Sockets | 5X852 | 120 vac-10 A |
| Dayton Controls | Relay Sockets | 5X853 | 120 vac-10 A |
| Dayton Controls | Relay S.P.D.T. R9, R12 | 5X835 | 120 vac-13 A |
| Dayton Controls | Relay D.P.D.T. | 5X838 | 120 vac-12 A |
| Dayton Controls | Relay 3.P.D.T. | 5X841 | 120 vac-11 A |
| Cramer | Hour Counter | 6X143 | 120 vac |
| Dayton Controls | 7-Day Clock 71 | 1A219 | 120 vac-15 A |
| Micro by Honeywell | 3-position switch 50 | PT-FEF102C | 120 vac-5 A |

-continued

| MANUFACTURER | DESCRIPTION | MODEL | VOLTS & AMPS |
|---|---|---|---|
| Micro by Honeywell | 3-position switch | 13AT2 | 120 vac-5 a |
| Dayton Controls | Cable Ties | 6X750 | - - - - |
| Dayton Controls | Terminal Connectors | 4X306 | #14-wire |
| Carol | Wire #14 THHN | 6x793-4-5-6-7 | 600 vac |
| AMP | Pilot Lights | - - - - | 120 vac |
| Buss | Fuse Block | Panel Twist | 15 A |
| Allen Bradley | Terminal | #14-4-wire | 30 A |
| Hoffman | Controller Cabinet | A36N24B | - - - - |
| Hoffman | 3" Louver for Cabinet | AVK23 | - - - - |
| McGuill | SPST Toggle Switch | - - - - | 120 vac-15 A |
| McGuill 120 vac-15 A | SPDT Toggle Switch | - - - - | |
| McGuill | DPDT Momentary Switch 60 | - - - - | 120 vac-15 A |
| Minn-Honeywell | P.S.I. Control | L404A | 120 vac-15 A |
| Minn-Honeywell | Modulation Series 90 L91A | L91A | 24 vac |
| Minn-Honeywell | Modulation End Switch-SPDT | 51,52,53 | 120 vac-15 A |

A suitable type of boiler which can be employed with this invention is any boiler or system which contains full modulation such as those manufactured by Cleaver-Brooks, York Shipley and many other manufacturers.

I claim:

1. Control apparatus for selecting any one of a plurality of parallel boiler units to serve as a lead boiler, with the others in said plurality operating as lag boilers, with each of said boilers capable of providing outputs indicative of a failure mode, and with each of said boilers capable of providing a modulation of operation between a lead pressure value and a lag pressure value, based on an internal program individual control of each boiler, comprising:

first selection means for selecting any one of said plurality of boilers to operate as said lead boiler, lead pressure means responsive to said selected boiler for monitoring the lead pessure output of said selected boiler to determine operation in an accepable range, selectively operated means responsive to said first selection means to enable at least one other boiler in said plurality to operate as a lag boiler when selected, timing means responsive to said monitored lead pressure and coupled to said selectively operated means to cause said means to operate after a given period of operation of said lead boiler at said lead pressure, whereby said lag boiler is selected to aid said lead boiler in operation even though said monitored pressure is within said acceptable range.

2. The apparatus according to claim 1, wherein said first selection means includes a setable timer capable of selectively operating over given time periods to provide a sequence for selecting any given one of said boilers to operate as said lead boiler for one period in said sequence and to select any other one of said boilers to operate as said lead boiler for another period in said sequence.

3. The apparatus according to claim 1, wherein said boilers are steam boilers.

4. The apparatus according to claim 1, wherein said lead boiler is controlled to operate at full modulation.

5. The apparatus according to claim 1, further includig selectively operated power means for applying operating power to said control apparatus in a control mode and for removing power in a by pass mode to enable said plurality of boilers to operate according to said internal programs.

6. The apparatus according to claim 1 further including;

failure monitoring means coupled to each of said boilers and operative to provide an output indicative of one of said failure modes, and means responsive to said output for providing an alarm to notify a user of said failure and for transferring control of said failed boiler to another one of said plurality.

7. The apparatus according to claim 6, wherein one of said failure modes is the loss of flame in one of said boilers.

8. The apparatus according to claim 6, wherein one of said failure mode is a lower water state in one of said boilers.

9. The apparatus according to claim 6, wherein one of said failure modes is an excessive smoke condition in one of said boilers.

10. The apparatus according to claim 6, wherein one of said failure modes is the loss of power in one of said boilers.

* * * * *